United States Patent [19]

Almqvist et al.

[11] 4,033,362

[45] July 5, 1977

[54] FILTER FOR TOBACCO SMOKE

[75] Inventors: Sven-Olof Almqvist, Saltsjobaden; Curt R. Enzell, Lidingo; Lasse O. Hjern, Vallentuna, all of Sweden; Antoine Artho, Boncourt; Robert Koch, Porrentruy, both of Switzerland

[73] Assignees: Svenska Tobaks AB, Stockholm, Sweden; F.J. Burrus & Cie, Boncourt, Switzerland

[22] Filed: Feb. 26, 1975

[21] Appl. No.: 553,309

[30] Foreign Application Priority Data

Mar. 13, 1974 Sweden ..... 74033473

[52] U.S. Cl. ..... 131/264; 131/10 A

[51] Int. Cl.[2] ..... A24D 1/04

[58] Field of Search ..... 131/264, 266, 10.1, 131/10 A, 10.5

[56] References Cited

UNITED STATES PATENTS

| | | | |
|---|---|---|---|
| 3,066,681 | 12/1962 | Cohn | 131/10.1 X |
| 3,324,861 | 6/1967 | Gaisman | 131/10.5 X |
| 3,351,072 | 11/1967 | Baum et al. | 131/266 |
| 3,512,537 | 5/1970 | Pelletier | 131/10.3 X |
| 3,596,663 | 8/1971 | Schultz | 131/10 A |
| 3,602,232 | 8/1971 | Grauvogel et al. | 131/10.5 |
| 3,714,949 | 2/1973 | King | 131/10.5 |

FOREIGN PATENTS OR APPLICATIONS

| | | | |
|---|---|---|---|
| 431,169 | 8/1967 | Switzerland | 131/10.5 |

OTHER PUBLICATIONS

"Silicon Rubber as a Selective Barrier" by Kammermeyer Industrial & Engineering Chemistry, vol. 49, No. 10, pp. 1685, 1686, Oct. 1957.

*Primary Examiner*—Robert W. Michell
*Assistant Examiner*—V. Millin
*Attorney, Agent, or Firm*—Cushman, Darby & Cushman

[57] ABSTRACT

The present invention relates to a new type of filter for tobacco smoke, which filter has a diffusion portion, in which the smoke stream is separated from the outer air by means of a membrane, which is permeable to low molecular smoke constituents.

2 Claims, 2 Drawing Figures

FILTER FOR TOBACCO SMOKE

The present invention relates to a new type of filter for tobacco smoke, which filter is very effective for selective removal of low molecular, often noxious components in tobacco smoke, such as hydrogen, methane, hydrogen cyanide, ethyne, carbon monoxide, acetaldehyde and acrolein from the mainstream smoke. After filtration through these filters a smoke is obtained, which is mild and pleasant to the smoker, and this by considerable reduction of the concentration of several of the compounds existing in smoke and generally considered as irritating substances. These filters can be used as an integral part of smokeables, such as cigarettes, but they can also be in a transferable form so that they can be transferred from one cigarette etc. to another for repeated use.

In a filter according to the present invention the smoke is brought into contact with a permeable membrane with a large surface, whose other surface is in contact with the air. This takes place at a low rate and consequently irritating, low molecular compounds are effectively removed from the smoke and, as is shown below, the contents of certain low molecular compounds are reduced by as much as 60% or more.

A filter according to the present invention is characterized by a diffusion portion, in which the smoke stream is separated from the outer air by means of a membrane, which is permeable to low molecular smoke components. This enables a diffusion of the above compounds of low molecular weight. This diffusion portion has preferably a length of 5–75 mm and consists of one or more channels arranged either axially or in helicoidal form, and the walls of the channels consist of the permeable membrane. The walls of the channel are made of thin (0,01–0,3 mm) foils and they are permeable to the molecule types, the concentration of which is to be reduced. The foil material can be fibrous or nonfibrous polymer material, which is permeable to these low molecular compounds, and as examples of such materials paper, polyethylene, polypropylene and silicone rubber can be mentioned. The diffusion portion of the filter is provided with a mouthpiece section at one end and at the other end attached to the smokeables, e.g. a cigarette, either directly or via an intermediate section. The mouthpiece section and/or the intermediate section can be common filter elements of any material known in this art. The mouthpiece section and/or the intermediate section may also have the form and the function of a nozzle.

The present invention is described more in detail by means of the following example and the enclosed drawing, which illustrate an embodiment of the invention.

On the enclosed drawing FIG. 1 shows a longitudinal section of a filter and FIG. 2 shows a cross section along the line 2–2 in FIG. 1.

Figure 1:
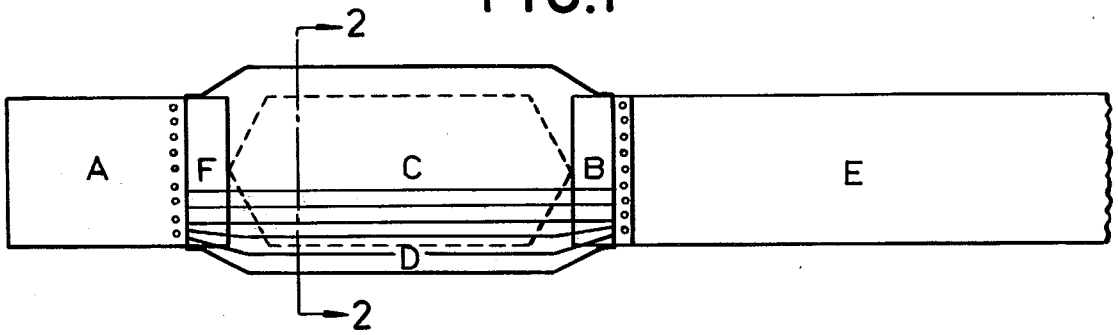
FIG. 1 shows a filter end A with a front portion F, an insert C, a filter element B, which is attached to the smokeables E, and channel walls D.
Figure 2:
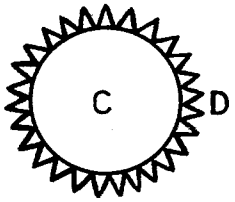
FIG. 2 is a cross section along the line 2—2 in FIG. 1 showing the insert C and the channel walls D, which limit the channels.

EXAMPLE.

A filter cigarette is produced by joining a filter end A of cellulose acetate and with a length of 8 mm, an insert C of hard paper and with a length of 40 mm and a filter element B of cellulose acetate and with a length of 8 mm, the latter element being attached to a cigarette E, and all these parts have an outer diameter of about 8 mm. Around the insert C a corrugated paper D of 0,03 mm thickness and with a normal air permeability (54 $ml/cm^2 \cdot min$ at 100 mm water column) is wound. This paper is attached to the filter end A and the filter element B, both of cellulose acetate. These two units of cellulose acetate and the insert C are designed in such a way that the smoke is conducted from the whole cross section of B along the channels (limited by C and D) and then towards the cross section of A. The surfaces C and D comprise the walls of the channels and in this example there are 28 channels with triangular cross sections, whose sides are 1 mm.

The filter according to this example was tested under standard smoke conditions. The results were compared to those obtained at tests with the same type of cigarette without filter, and the following concentration reductions (in %) for cigarettes with a filter according to this example were obtained: nicotine 20%, smoke condensate ("tar") 30%, acetaldehyde 66%, acrolein 66%, carbon monoxide 60%, acetone 60%, phenol 3%, 2,4-dimethylphenol 0% and indolene 3%.

Several other embodiments of the diffusion portion than that described in the example and on the drawing are of course possible. The inlet and/or outlet end(s) of the filter portion and/or the diffusion portion can be provided with vents around the periphery. the diffusion portion and/or the filter elements A and B may contain e.g. sorbing or catalytically active materials. The insert C can also have another design or be quite omitted. What is essential for the present invention is that the smoke stream is separated from the outer air by means of a membrane, which is permeable to the types of molecules, whose concentration is to be selectively reduced.

What is claimed is:

1. Filter for tobacco smoke, comprising a diffusion portion consisting of a membrane separating the smoke stream from the outer air and being permeable to low molecular compounds in the gaseous phase of the smoke for selective removal of low molecular compounds from said tobacco smoke to the surrounding air.

2. Filter according to claim 1 characterized in that it contains an insert, which forces the smoke to pass along the walls of the diffusion portion to subject as much as possible of the smoke to the diffusion process.

* * * * *